US005705099A

United States Patent [19]

Nagata et al.

[11] Patent Number: 5,705,099

[45] Date of Patent: Jan. 6, 1998

[54] RESISTIVE MATERIAL COMPOSITION, RESISTIVE PASTE, AND RESISTOR

[75] Inventors: Keisuke Nagata, Kyoto; Hiroji Tani, Nagaokakyo, both of Japan

[73] Assignee: Murata Manufacturing Co., Ltd., Kyoto-fu, Japan

[21] Appl. No.: 633,291

[22] Filed: Apr. 16, 1996

[30] Foreign Application Priority Data

Apr. 18, 1995 [JP] Japan ..... 7-117818

[51] Int. Cl.[6] ..... H01B 1/08; H01C 7/18

[52] U.S. Cl. ..... 252/519; 252/521; 106/1.22; 423/21.1; 428/357; 428/689; 428/922; 338/204

[58] Field of Search ..... 252/518, 519, 252/521; 106/1.22; 423/21.1; 428/357, 689, 922; 338/204

[56] References Cited

U.S. PATENT DOCUMENTS 4,536,328 8/1985 Hankey ..... 252/518
4,814,107 3/1989 Steinberg ..... 252/512

FOREIGN PATENT DOCUMENTS 0596481 2/1984 Japan .
62-5508 1/1987 Japan .
63224301 9/1989 Japan .
2249203 10/1990 Japan .

OTHER PUBLICATIONS

Labrinche et al "Evalustion of Deposition Techniques of Cathode Materials..." Mat. Res. Bill. vol. 28, pp. 101–109, 1993 (No Month).

*Primary Examiner*—Paul Lieberman
*Assistant Examiner*—Mark Kopec
*Attorney, Agent, or Firm*—Ostrolenk, Faber, Gerb & Soffen, LLP

[57] ABSTRACT

Disclosed are a resistive paste that can be fired in a neutral or reducing atmosphere to give a resistor having a high sheet resistivity value and a satisfactory TCR value even on low-temperature-sintering substrates, a resistive material composition that constitutes the resistive paste, and also a resistor that is formed from the resistive paste to realize a high sheet resistivity value and a satisfactory TCR value. A first resistive material of $Ca_xSr_{1-x}RuO_3$ (where x is from about 0.25 to 0.75 mols), a second resistive material of $La_ySr_{1-y}CoO_3$ (where y is from about 0.40 to 0.60 mols) and titanium oxide ($TiO_2$) are mixed, and a non-reducible glass frit and an organic vehicle are added thereto to form the resistive paste.

19 Claims, 1 Drawing Sheet

RESISTIVE MATERIAL COMPOSITION, RESISTIVE PASTE, AND RESISTOR

BACKGROUND OF THE INVENTION

1. Field of the Invention

The present invention relates to a resistive material composition, a resistive paste which can be fired in a neutral or reducing atmosphere, and a resistor to be formed by the use of the resistive paste.

2. Description of the Related Art

In general, a ceramic substrate comprising alumina, zirconia or the like has circuit patterns for electrodes, resistors, etc., in order that various electronic parts can be mounted thereon. Electrodes (electrode patterns) are generally formed on the substrate by screen-printing a noble metal paste comprising silver, a silver-palladium alloy or the like and a glass frit followed by firing the thus-printed paste in air.

In order to obtain small-sized, high-density electronic products, methods of three-dimensionally disposing conductors in laminate substrates have heretofore been proposed. Where inner layers are wired and laminated on conventional alumina substrates (high-temperature-sintering substrates), high-melting-point metals such as tungsten, molybdenum, etc. are used as conductor materials since alumina is sintered at high temperatures. However, since the materials have a high specific resistivity, they are problematic in that their use is limited and they are practical. In order to solve this problem, substrates that can be sintered at low temperatures not higher than 1000° C. and that can be laminated with inner layers of electrode materials such as silver, palladium, copper, etc. (for example, low-temperature-sintering substrates such as ceramic/glass composite substrates), have been utilized. As electrode materials applicable to such low-temperature-sintering substrates, used are noble metal pastes such as those mentioned above. However, since such noble metal pastes are not only expensive but also problematic in their migration resistance, the replacement of such expensive noble metal pastes by base metal pastes comprising, as the conductive component, copper, nickel, aluminium or the like, has become accepted in this technical field. Such base metal pastes can be screen-printed on substrates and then fired in a neutral or reducing atmosphere to give inexpensive electrode patterns.

In this latter case, it is desirable that the resistive pastes which are to form resistors (resistor patterns) on the substrates, through which the plural base metal electrodes formed by firing the printed base metal pastes are connected with each other, can also be fired in a neutral or reducing atmosphere.

Therefore, various resistive pastes that can be fired in a neutral or reducing atmosphere to form resistors (resistor patterns) have heretofore been proposed. Such resistive pastes includes, for example, resistive pastes comprising $LaB_6$ such as those described in Japanese Patent Publication No. 59-6481, resistive pastes comprising $NbB_2$ such as those described in Japanese Patent Laid-Open No. 63-224301, resistive pastes comprising solid solutions of $Nb_xLa_{1-x}B_{6-4x}$ such as those described in Japanese Patent Laid-Open No. 2-249203, etc.

It is possible to make resistive pastes comprising $Ca_xSr_{1-x}RuO_3$ which exhibit resistance values (face resistance values) that vary within a broad range by varying the mixing ratio of conductive materials and glass frit contained therein. However, such resistive pastes are problematic in that the resistance values of the resistors formed from them on low-temperature-sintering substrates such as ceramic-glass composite substrates are lowered to from 1/100 to 1/1000 or so of the resistance values of the resistors formed on alumina substrates (high-temperature-sintering substrates) and in that the characteristics such as the temperature coefficient of resistance (TCR), etc. of the former resistors are unsatisfactory. In particular, it is impossible to form resistors having high sheet resistivity values of not lower than 10 kΩ/square from such resistive pastes. For these reasons, the resistive pastes are problematic in that they could not have satisfactory characteristics that are needed for practical use. These problems are essentially caused by the movement of the glass component between the substrates and the resistors formed thereon.

SUMMARY OF THE INVENTION

The present invention is to solve the above-mentioned problems, and its object is to provide a resistive paste that can be fired in a neutral or reducing atmosphere to give a resistor having a high sheet resistivity value and a satisfactory TCR value even on low-temperature-sintering substrates, a resistive material composition that constitutes the resistive paste, and also a resistor that is formed from the resistive paste to realize a high sheet resistivity value and a satisfactory TCR value.

Specifically, the present invention provides a resistive material composition, by which the above-mentioned object is attained and which is characterized in that it comprises a first resistive material of a general formula $Ca_xSr_{1-x}RuO_3$ (where x is from about 0.25 to 0.75 mols, preferably about 0.3 to 0.6), a second resistive material of a general formula $La_ySr_{1-y}CoO_3$ (where y is from about 0.40 to 0.60 mols, preferably about 0.45 to 0.55), and titanium oxide ($TiO_2$).

The present invention also provides a resistive material composition which is characterized in that it comprises a first resistive material of a general formula $Ca_xSr_{1-x}RuO_3$ (where x is from about 0.25 to 0.75 mols), a non-reducible glass frit, a second resistive material of a general formula $La_ySr_{1-y}CoO_3$ (where y is from about 0.40 to 0.60 mols), and from about 1 to 15 parts by weight, preferably about 3 to 14 parts, relative to 100 parts by weight of the sum of the first and second resistive materials and the non-reducible glass frit, of titanium oxide ($TiO_2$).

One embodiment of the resistive material composition is such that the ratio of the first resistive material to the non-reducible glass frit is from about 65:35 to 5:95 by weight and, preferably about 60:40 to 9:91.

The present invention further provides a resistive paste characterized in that it comprises the above-mentioned resistive material composition and an organic vehicle added thereto.

One embodiment of the resistive paste comprising the above-mentioned resistive material composition is such that it is prepared by adding an organic vehicle to a composition comprising from about 4 to 62 parts by weight of the first resistive material, from about 5 to 20 parts by weight of the second resistive material, from about 28 to 90 parts by weight of a non-reducible glass frit and from about 1 to 15 parts by weight of titanium oxide ($TiO_2$), followed by kneading.

The resistive paste of the present invention can be used for forming resistors on a low-temperature-sintering substrate having a composition comprising from about 15 to 75% by weight of BaO, from about 25 to 80% by weight of $SiO_2$, 30% by weight or less of $Al_2O_3$, from about 1.5 to 5% by weight of $B_2O_3$ and from about 1.5 to 5% by weight of CaO.

The present invention further provides a resistor to be formed by coating and firing the resistive paste on a substrate.

DETAILED DESCRIPTION OF THE INVENTION

Figure 1:
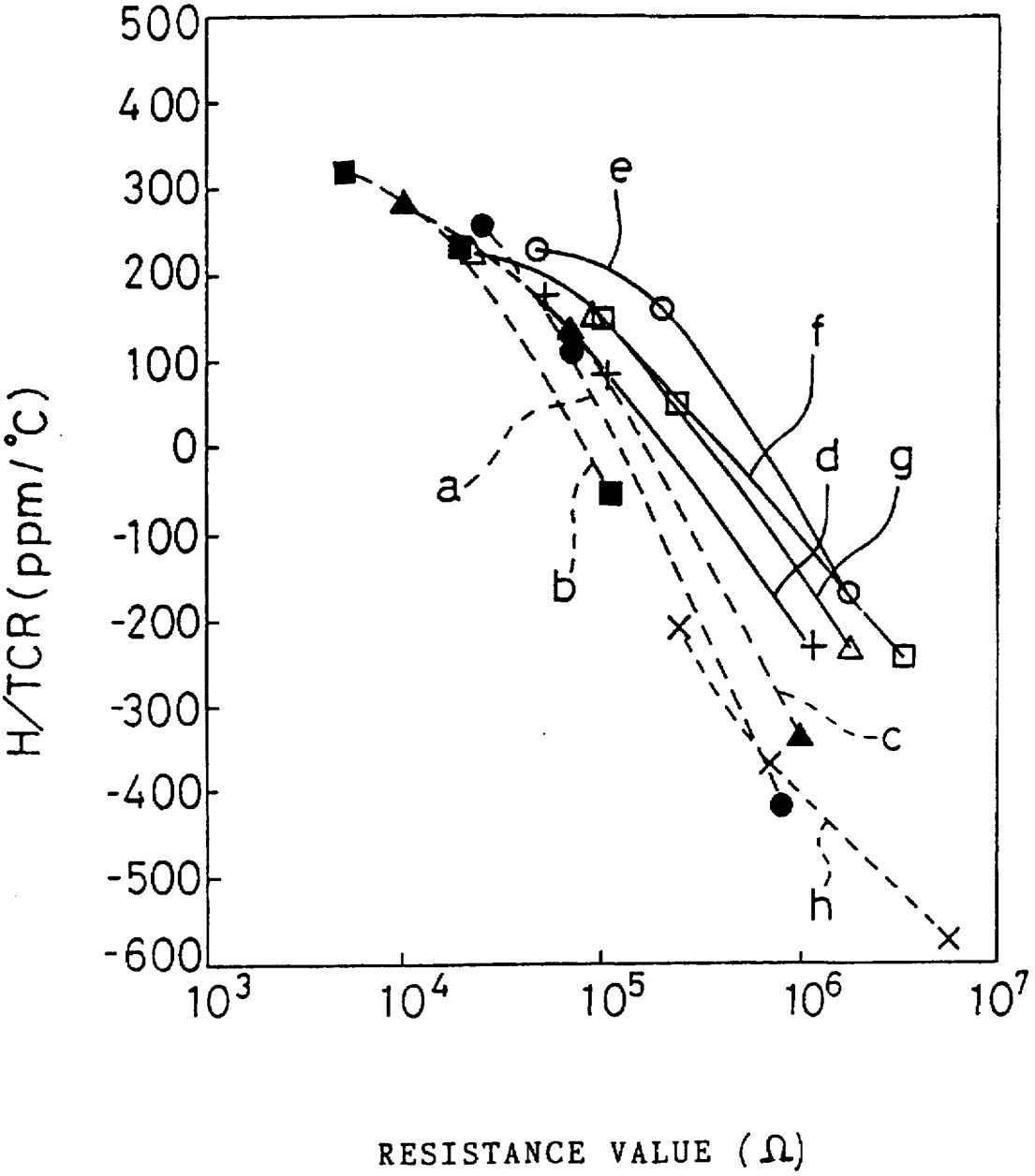
FIG. 1 is a graph showing the relationship between the resistance values and TCR (H/TCR) values of the samples prepared in the examples and the comparative examples described hereinunder.

The resistive material composition of the present invention comprises a first resistive material of a general formula $Ca_xSr_{1-x}RuO_3$ (where x is from about 0.25 to 0.75 mols), a second resistive material of a general formula $La_ySr_{1-y}CoO_3$ (where y is from about 0.40 to 0.60 mols), and titanium oxide ($TiO_2$). A resistive paste can be obtained by adding a non-reducible glass frit and an organic vehicle to the resistive material composition. It is possible to coat and bake the resistive paste on a low-temperature-sintering substrate to form a resistor thereon having a high resistance value and a satisfactory TCR value that is near to 0 (zero). As opposed to this, it is difficult to realize resistors having high resistance values and having satisfactory TCR values if conventional resistive pastes are coated and fired on such a low-temperature-sintering substrate. The TCR values of the resistors formed from conventional resistive pastes on a low-temperature-sintering substrate are much remote from 0 (zero), that is, they have large plus (+) or minus (−) values.

In the first resistive material of $Ca_xSr_{1-x}RuO_3$ that constitutes the resistive material composition of the present invention, x falls between about 0.25 mols and 0.75 mols. This is because if x falls outside the defined scope, the non-reducible glass frit content of the solid resistor composition increases, resulting in a rapid increase in the resistance value of the resistor formed from the composition and therefore resulting in a worsening of the reproducibility of the resistance value of the resistor.

It is preferable that the particles of the first resistive material of $Ca_xSr_{1-x}RuO_3$ in the resistive material composition of the present invention have particle sizes falling between about 0.1 μm and 5 μm, more preferably between about 0.5 μm and 3 μm. It is also preferable that the particles of the second resistive material of $La_ySr_{1-y}CoO_3$ in the composition have particle sizes falling between about 0.5 μm and 5 μm, more preferably between about 1 μm and 3 μm.

The non-reducible glass frit for use in the present invention may be selected from borosilicate glass and boroaluminosilicate glass with Ba, Ca or other alkaline earth metals, etc. It is desirable that the particles of the non-reducible glass frit have particle sizes falling between about 1 μm and 10 μm, more preferably between about 1 μm and 5 μm.

Preferably, the resistive material composition of the present invention comprises from about 1 to 15 parts by weight, relative to 100 parts by weight of the sum of the first and second resistive materials and the non-reducible glass frit, of titanium oxide ($TiO_2$). This is because when the titanium oxide content of the composition is less than 1 part by weight, its effect of controlling the resistance value and the TCR value of the resistor to be formed is insufficient and when it is more than 15 parts by weight, not only is the resistance value of the resistor too high but also the TCR value thereof is extremely unsatisfactory.

Also preferably, the ratio of the first resistive material to the non-reducible glass frit in the resistive material composition of the present invention is such that the first resistive material is from about 5 to 65 parts by weight and the non-reducible glass frit is from about 35 to 95 parts by weight. As a result, the resistive paste comprising the composition can adhere and be fixed firmly on a substrate after having been printed and fired thereon, and the glass component does not flow out of the paste. If, however, the proportion of the non-reducible glass frit is lower than the defined range, the adhesiveness between the resistive paste comprising the composition and the substrate is low, or if it is higher than the defined range, the glass component flows out of the paste to worsen the solderability of electrodes on the substrate.

To prepare the resistive paste of the present invention, an organic vehicle is added to and kneaded with a mixture (solid component) comprising the first and second resistive materials and a non-reducible glass frit, giving the resulting resistive paste the necessary printability. For this, employable are various organic vehicles which are generally used in ordinary resistive pastes for forming thick film resistors and which are prepared, for example, by dissolving an ethyl cellulose resin or acrylic resin in a terpene solvent such as α-terpineol or in a high-boiling point solvent such as kerosene, butyl Carbitol, Carbitol acetate or the like. If desired, additives may be added to the paste so as to make it thixotropic.

The resistive paste of the present invention which is obtained by kneading a composition comprising from about 4 to 62 parts by weight of the first resistive material, from about 5 to 20 parts by weight of the second resistive material, from about 28 to 90 parts by weight of a non-reducing glass frit and from about 1 to 15 parts by weight of titanium oxide, along with an organic vehicle, can be printed and fired even on a low-temperature-sintering substrate to surely form thereon a resistor a high resistance value and a TCR value near to zero. Therefore, this is one preferred embodiment of the present invention.

In the preferred embodiment of the present invention, the proportions of the first resistive material, the second resistive material, the non-reducible glass frit and the titanium oxide ($TiO_2$) are defined to those falling within the above-mentioned ranges for the following reasons. If the proportions are outside the defined ranges, they could not sufficiently exhibit the effect of increasing the resistance values of the resistors to be formed, or the resistance values of the resistors rapidly increase, or the resistors do not have satisfactory TCR values.

The resistive paste of the present invention can be coated and fired on even a low-temperature-sintering substrate having a composition comprising from about 15 to 75% by weight of BaO, from about 25 to 80% by weight of $SiO_2$, 30% by weight or less of $Al_2O_3$, from about 1.5 to 5% by weight of $B_2O_3$, and from about 1.5 to 5% by weight of CaO, to form thereon a resistor having a high resistance value and a satisfactory TCR value.

The resistor formed by coating and firing the resistive paste of the present invention on a substrate has good adhesiveness to the substrate. Even if the resistor is formed on a low-temperature-sintering substrate, it still has a high effective sheet resistivity value and a satisfactory effective TCR value.

Next, the characteristics of the present invention are described in more detail with reference to the following examples, which, however, are not intended to restrict the scope of the present invention.

EXAMPLES

A) Preparation of low-temperature-sintered substrates and formation of electrode patterns thereon BaO, $SiO_2$, $Al_2O_3$, CaO and $B_2O_3$ were combined at a weight ratio of 30:60:5:2:3, ground, mixed and calcined at from 850° C. to 950° C. and again ground into powder. An organic binder was added to the thus-obtained powder, and the resulting mixture was formed into a sheet having a thickness of 128 μm by means of doctor-blading. The sheet was dried and then cut into green substrates of a predetermined size. These green substrates were pre-sintered and sintered in an electric furnace having therein a nitrogen-steam atmosphere comprising nitrogen gas as the carrier gas and containing minor amounts of oxygen and hydrogen gasses ($N_2$ content: from 99.7 to 99.8%) at from 850° C. to 1000° C., to obtain low-temperature-sintered substrates. A copper paste was printed on each of these low-temperature-sintered substrates by means of screen-printing and fired in a nitrogen atmosphere to form electrodes (electrode patterns) thereon.

(B) Preparation of first resistive material samples

As raw material substances for the first resistive materials, powdery $RuO_2$, $CaCO_3$ and $SrCO_3$ were weighed at predetermined proportions to have a composition of $Ca_xSr_{1-x}RuO_3$ (where x is 0.3 or 0.6) and subjected to thermal synthesis by holding them in air at 1100° C. for 2 hours to obtain solid solutions. In this step of thermal synthesis, the heating speed was 3° C./min. Each of the thus-obtained solid solutions (synthetic products) was put into a partially-stabilized zirconia pot having therein grinding media and a pure water medium and set in a shaking mill, where the product was ground into powdery particles having a mean particle size of from 2 to 3 μm. Then the resulting powder was dried. Thus were obtained various first resistive material samples.

(C) Preparation of non-reducible glass frit sample

As raw material substances for a non-reducible glass frit, $B_2O_3$, $SiO_2$, BaO, CaO and $Al_2O_3$ were prepared, mixed at a molar ratio of 36.0:31.7:18.0:9.3:5.0, melted at a temperature falling between 1200° C. and 1350° C., and then immediately put into pure water to rapidly cool the melt. Next, this was ground in a shaking mill into powdery particles having a mean particle size of 5 μm or less. Thus was obtained a non-reducible glass frit sample. In this example, the above-mentioned oxides were used as the raw materials. However, the corresponding carbonates can also be used as the raw materials.

(D) Preparation of second resistive material sample

Powdery $La_2O$, $SrCO_3$ and $Co_2O_3$ were weighed at predetermined proportions to have a composition of $La_{0.5}Sr_{0.5}CoO_3$, mixed and ground. Then, the resulting mixture was put into a crucible and subjected to thermal synthesis by holding it in air at 1050° C. for 5 hours. The thus-obtained synthetic product was put into a partially-stabilized zirconia pot having grinding media and a pure water medium therein and set in a shaking mill where the product was ground into powdery particles having a mean particle size of from 2 to 3 μm. Then, the resulting powder was dried to obtain a second resistive material sample.

(E) Preparation of titanium oxide ($TiO_2$) powder sample

A commercial $TiO_2$ product was put into a partially-stabilized zirconia pot having grinding media and a pure water medium therein and set in a shaking mill where the product was ground into powdery particles having a mean particle size of from 2 to 3 μm. Then, the resulting powder was dried to obtain a titanium oxide ($TiO_2$) powder sample.

(F) Preparation of resistive paste samples

The first resistive material sample ($Ca_xSr_{1-x}RuO_3$), the second resistive material sample ($La_{0.5}Sr_{0.5}CoO_3$), the non-reducible glass frit sample and the titanium oxide powder sample that had been prepared in the above were mixed at various ratios shown in Table 1 below. An organic vehicle obtained by dissolving an acrylic resin in α-terpineol was added and with the resulting mixture kneaded in a kneading device such as a three-roll mill or the like. The mixing ratio of the above-mentioned materials mixture to the organic vehicle was about 70:30 by weight. Thus were obtained various resistive paste samples.

TABLE 1

| | | Proportions of Essential Components | | | | | | |
|---|---|---|---|---|---|---|---|---|
| | | First Resistive | | Second Resistive | | Face | TCR (ppm/°C.) | |
| Sample Number | Molar Ratio x (mols) | material Sample (wt. %) | Glass Frit Sample (wt. %) | material Sample (wt. %) | Amount of $TiO_2$ Added (wt. %) | Resistance Value (Ω/square) | between −55° C. and 25° C. | between 25° C. and 150° C. |
| *1 | 0.3 | 9 | 82 | 9 | 0 | 780K | −393 | −410 |
| *2 | 0.3 | 27 | 64 | 9 | 0 | 67K | 130 | 111 |
| *3 | 0.3 | 45 | 46 | 9 | 0 | 25K | 277 | 256 |
| *4 | 0.6 | 9 | 78 | 13 | 0 | 111K | −38 | −53 |
| *5 | 0.6 | 26 | 61 | 13 | 0 | 19K | 259 | 231 |
| *6 | 0.6 | 44 | 43 | 13 | 0 | 5.1K | 341 | 319 |
| *7 | 0.6 | 8 | 75 | 17 | 0 | 986K | −309 | −336 |
| *8 | 0.6 | 25 | 58 | 17 | 0 | 70K | 157 | 140 |
| *9 | 0.6 | 42 | 41 | 17 | 0 | 9.5K | 302 | 286 |
| *10 | 0.3 | 9 | 82 | 9 | 0.5 | 792K | −405 | −420 |
| *11 | 0.3 | 27 | 64 | 9 | 0.5 | 72K | 127 | 112 |
| 12 | 0.3 | 9 | 82 | 9 | 3 | 1.1M | −218 | −233 |
| 13 | 0.3 | 27 | 64 | 9 | 3 | 108K | 97 | 86 |
| 14 | 0.3 | 45 | 46 | 9 | 3 | 52K | 190 | 178 |
| 15 | 0.6 | 8 | 75 | 17 | 5 | 1.8M | −157 | −170 |
| 16 | 0.6 | 25 | 58 | 17 | 5 | 201K | 171 | 163 |
| 17 | 0.6 | 42 | 41 | 17 | 5 | 47K | 242 | 230 |
| 18 | 0.3 | 9 | 82 | 9 | 10 | 3.4K | −232 | −245 |
| 19 | 0.3 | 27 | 64 | 9 | 10 | 238K | 69 | 52 |

TABLE 1-continued

| Sample Number | Molar Ratio x (mols) | Proportions of Essential Components: First Resistive material Sample (wt. %) | Glass Frit Sample (wt. %) | Second Resistive material Sample (wt. %) | Amount of $TiO_2$ Added (wt. %) | Face Resistance Value (Ω/square) | TCR (ppm/°C.) between −55° C. and 25° C. | TCR (ppm/°C.) between 25° C. and 150° C. |
|---|---|---|---|---|---|---|---|---|
| 20 | 0.3 | 45 | 46 | 9 | 10 | 102K | 165 | 152 |
| 21 | 0.6 | 9 | 78 | 13 | 14 | 1.8M | −221 | −235 |
| 22 | 0.6 | 26 | 61 | 13 | 14 | 97K | 171 | 157 |
| *23 | 0.6 | 44 | 43 | 13 | 14 | 23K | 240 | 226 |
| *24 | 0.6 | 9 | 78 | 13 | 17 | 5.8M | −550 | −573 |
| *25 | 0.6 | 26 | 61 | 13 | 17 | 693K | −335 | −368 |
| *26 | 0.6 | 44 | 43 | 13 | 17 | 245K | −185 | −207 |

(G) Formation of resistor (resistor pattern) samples

Next, the thus-obtained resistive pastes were individually screen-printed on the low-temperature-sintered substrate that had been prepared in the above. The resistive paste thus printed was such that the length was 1 mm, the width was 1 mm and the dry film thickness was about 20 μm. The substrates thus printed with the resistive paste were dried at 120° C. for 10 minutes and then fired in a tunnel furnace having a nitrogen atmosphere at a peak temperature of 900° C. for 10 minutes, whereby a resistor (resistor pattern) was formed on each substrate. Thus, resistor (resistor pattern) samples were prepared.

The sheet resistivity value and the temperature coefficients of resistance TCR (H/TCR: between 25° C. and 150° C., and C/TCR: between −55° C. and 25° C.) of each of the resistor samples Nos. 1 to 26 were measured. Table 1 shows the data thus obtained.

In Table 1, the samples marked with (*) are comparative samples which are outside the scope of the present invention. Precisely, sample Nos. 1 to 9 do not contain titanium oxide, the amount of titanium oxide added to sample Nos. 10 and 11 is 0.5 parts by weight or is smaller than the range defined in the invention, and the amount of titanium oxide added to sample Nos. 24 to 26 is 17 parts by weight or is larger than the range defined in the invention.

The sheet resistivity values in Table 1 were those as measured at 25° C., using a digital volt meter.

FIG. 1 shows the relationship between the sheet resistivity values of the resistor samples as produced herein and the H/TCR values thereof. The details of the code symbols (a to h) applied to the lines in FIG. 1 are shown in Table 2 below, where the molar ratio (x) in the first resistive material sample ($Ca_xSr_{1-x}RuO_3$) and the amounts of the first resistive material sample, the non-reducible glass frit and the second resistive material added are shown. In Table 2, the samples marked with (*) are comparative samples which are outside the scope of the present invention.

TABLE 2

| Code | Molar Ratio x | Proportions of Essential Components (wt. %) (first resistive material)/(glass frit)/(second resistive material) | Amount of $TiO_2$ Added (wt. %) |
|---|---|---|---|
| *a | 0.3 | from 9/82/9 to 45/46/9 | 0.05 |
| *b | 0.6 | from 9/78/13 to 44/43/13 | 0 |
| *c | 0.6 | from 8/75/17 to 42/41/17 | 0 |
| d | 0.3 | from 9/82/9 to 45/46/9 | 3 |
| e | 0.6 | from 8/75/17 to 42/41/17 | 5 |
| f | 0.3 | from 9/82/9 to 45/46/9 | 10 |
| g | 0.6 | from 9/78/13 to 44/43/13 | 14 |
| *h | 0.6 | from 9/78/13 to 44/43/13 | 17 |

From FIG. 1, it can be seen that the characteristic curves of the samples (d, e, f, g) of the present invention which contain titanium oxide within the scope of the present invention are shifted upward, as compared with the comparative samples which do not contain or contain TiO2 whose amount is, however, outside the scope of the present invention. It is also seen that when the samples of the present invention are compared with the comparative samples at the same resistance value, the TCR levels of the former are nearer to 0 ppm/°C. than those of the latter. From this, it is understood that the addition of titanium oxide ($TiO_2$) to the resistive material compositions resulted in the improvement in the TCR levels of the resistors formed from the compositions. In addition, it is also understood that when titanium oxide whose amount is outside the scope of the present invention was added, its TCR-improving effect was not significant as compared with the case where no titanium oxide was added.

From Tables 1 and 2, it is seen that the resistor samples of the present invention which contain titanium oxide have higher resistance values and have TCR values nearer to 0 ppm/°C. than the comparative resistor samples not containing titanium oxide.

It is also seen therefrom that the comparative resistor samples (Nos. 10 and 11) containing 0.5 parts by weight of titanium oxide, which is lower than the scope of the present invention, do not always have satisfactory sheet resistivity values and TCR values and that the comparative resistor samples (Nos. 24, 25, 26) containing 17 parts by weight of titanium oxide, which is higher than the scope of the present invention, have not only unsatisfactory sheet resistivity values but also TCR values which are significantly remote from 0 (zero).

From these results, it is understood that the amount of titanium oxide to be added to the resistive material composition is preferably from 1 to 15 parts by weight.

In the above-mentioned examples, used was the non-reducible glass frit comprising $B_2O_3$, $SiO_2$, BaO, CaO and $Al_2O_3$ at a molar ratio of 36.0:31.7:18.0:9.3:5.0. However, the components constituting the non-reducible glass frit for use in the present invention and the compositional ratio of the components are not limited to only the illustrated ones but, needless-to-say, any other non-reducible glass frit comprising any other components and having any other compositional ratios can also be used in the present invention.

The above-mentioned examples have demonstrated the formation of the resistor samples on the low-temperature-sintered substrate comprising BaO, $SiO_2$, $Al_2O3$, CaO and $B_2O_3$ at a ratio of 30:60:5:2:3 by weight. However, the substrate on which the resistors of the present invention are formed is not limited to only the low-temperature-sintered substrate having the composition mentioned above. Needless-to-say, the present invention is applicable to the formation of the resistors on other various substrates or bases made of other various materials.

The present invention is not limited to only the above-mentioned examples with respect to the other various aspects. For example, the mixing ratio of the first and second resistive materials and the non-reducible glass frit, the amount of titanium oxide to be added, and the temperature conditions and the atmosphere conditions for firing the resistive paste can be variously changed or modified within the scope and the sprit of the present invention.

As has been described in detail hereinabove, the resistive material composition of the present invention comprises a first resistive material of the general formula $Ca_xSr_{1-x}RuO_3$ (where x is from about 0.25 to 0.75 mols), a second resistive material of a general formula, $La_ySr_{1-y}CoO_3$ (where y is from about 0.40 to 0.60 mols) and titanium oxide, and the resistive paste to be prepared by adding a non-reducible glass frit and an organic vehicle to the composition can be formed into resistors having high resistance values and having TCR values near to zero even on low-temperature-sintering substrates. When, if conventional resistive pastes are coated and fired on such low-temperature-sintering substrates, it is difficult to realize resistors having high resistance values and having satisfactory TCR values. The TCR values of the resistors formed from conventional resistive pastes on low-temperature-sintering substrates are much remote from zero, that is, they have large plus or minus values.

Where the resistive paste of the present invention comprises the first resistive material and the non-reducible glass frit at such a ratio that the former is from about 5 to 65 parts by weight and the latter is from about 35 to 95 parts by weight, along with an organic vehicle, and where it is used to form resistors on a low-temperature-sintering substrate, the adhesiveness between the resistors formed and the substrate is much improved and it is possible to inhibit or prevent the glass component from flowing out of the resistors formed. For these reasons, preferred is the embodiment of the resistive paste comprising the first resistive material and the non-reducible glass frit at said ratio.

Concretely, the resistive paste of the present invention can be formed into resistors having high resistance values and having TCR values near to zero, on ceramic-glass composite substrates such as a low-temperature-sintering substrate having a composition comprising from about 15 to 75% by weight of BaO, from about 25 to 80% by weight of $SiO_2$, about 30% by weight or less of $Al_2O_3$, from about 1.5 to 5% by weight of $B_2O_3$ and from amount 1.5 to 5% by weight of CaO.

While the invention has been described in detail and with reference to specific embodiments thereof, it will be apparent to one skilled in the art that various changes and modifications can be made therein without departing from the spirit and scope thereof.

What is claimed is:

1. A resistive material composition comprising:

a first resistive material of the general formula $Ca_xSr_{1-x}RuO_3$ where x is from about 0.25 to 0.75, a second resistive material of the general formula $La_ySr_{1-y}CoO_3$ where y is from about 0.40 to 0.60, and titanium oxide.

2. The resistive material composition as claimed in claim 1, in which x is about 0.3 to 0.6 and y is about 0.45 to 0.55.

3. The resistive material composition as claimed in claim 1 containing a non-reducible glass frit, and in which there are from about 1 to 15 parts by weight, relative to 100 parts by weight of the sum of the first and second resistive materials and the non-reducible glass frit, of titanium oxide.

4. The resistive material composition as claimed in claim 3, wherein the ratio of the first resistive material to the non-reducible glass frit is from about 65:35 to 5:95 by weight.

5. The resistive material composition as claimed in claim 4, wherein the ratio of the first resistive material to the non-reducible glass frit is from about 60:40 to 9:91 by weight, x is about 0.3 to 0.6 and y is about 0.45 to 0.55.

6. A resistive paste comprising the resistive material composition as claimed in claim 5 and an organic vehicle.

7. A resistive paste comprising the resistive material composition as claimed in claim 4 in combination with an organic vehicle.

8. A resistive paste comprising the resistive material composition as claimed in claim 3 in combination with an organic vehicle.

9. The resistive paste as claimed in claim 8, in which the resistive material composition comprises from about 4 to 62 parts by weight of the first resistive material, from about 5 to 20 parts by weight of the second resistive material, from about 28 to 90 parts by weight of a non-reducible glass frit and from about 1 to 15 parts by weight of titanium oxide.

10. A low-temperature-sintering substrate having the resistive paste as claimed in claim 8 thereon.

11. A low-temperature-sintering substrate having the resistive paste as claimed in claim 1 thereon.

12. The substrate as claimed in claim 11 in which the low-temperature-sintering substrate comprises from about 15 to 75% by weight of BaO, from about 25 to 80% by weight of $SiO_2$, 30% by weight or less of $Al_2O_3$, from about 1.5 to 5% by weight of $B_2O_3$ and from about 1.5 to 5% by weight of CaO.

13. A low-temperature-sintering substrate having the resistive paste as claimed in claim 6 thereon.

14. A resistor comprising the fired resistive paste as claimed in claim 6.

15. A resistor comprising the fired resistive paste as claimed in claim 7.

16. A resistor comprising the fired resistive paste as claimed in claim 8.

17. A low-temperature-sintering substrate having the resistor as claimed in claim 16 thereon.

18. A low-temperature-sintering substrate having the resistor as claimed in claim 15 thereon.

19. A low-temperature-sintering substrate having the resistor as claimed in claim 14 thereon.

* * * * *